US005927635A

United States Patent [19]

Black et al.

[11] Patent Number: 5,927,635

[45] Date of Patent: Jul. 27, 1999

[54] ROTATABLE HANDLE FOR DISPOSABLE SPOOL

[76] Inventors: Wesley F. Black, 2402 15th Ave., West; Robert J. Black, 2114 8th Ave., East; Ronald L. Black, 1710 22nd St., West; Charles D. Black, 2309 6th Ave., East, all of Williston, N. Dak. 58801

[21] Appl. No.: 08/925,806

[22] Filed: Sep. 9, 1997

Related U.S. Application Data

[63] Continuation-in-part of application No. 08/608,260, Feb. 28, 1996, Pat. No. 5,664,739.

[51] Int. Cl.[6] ..... B65H 75/40

[52] U.S. Cl. ..... 242/395; 242/588.2

[58] Field of Search ..... 242/395, 396, 242/396.5, 396.6, 396.7, 465, 405.1, 465.2, 405.3, 407, 407.1, 578, 578.2, 588, 588.2, 607, 609, 609.1, 610.6, 613, 613.1

[56] References Cited

U.S. PATENT DOCUMENTS

| | | | |
|---|---|---|---|
| 109,318 | 11/1870 | Holman . | |
| 472,593 | 4/1892 | Tache . | |
| 542,564 | 7/1895 | Koerner . | |
| 560,925 | 5/1896 | Pflueger . | |
| 686,456 | 11/1901 | Huebner . | |
| 851,770 | 4/1907 | Nichols . | |
| 908,743 | 1/1909 | Cavell . | |
| 1,212,376 | 1/1917 | McNamara . | |
| 1,455,167 | 5/1923 | Joslin | 242/405.3 |
| 1,572,174 | 2/1926 | Wolk | 242/405.3 |
| 1,579,886 | 4/1926 | Oxner . | |
| 1,696,056 | 12/1928 | Proctor . | |
| 1,823,165 | 9/1931 | Proctor | 242/405.3 |
| 2,254,534 | 9/1941 | Krieg | 242/405.3 |
| 2,366,755 | 1/1945 | Rogne . | |
| 2,505,151 | 4/1950 | Schweitz | 242/396.7 |
| 2,753,131 | 7/1956 | Erdman | 242/405.3 |
| 2,992,789 | 7/1961 | Sardeson | 242/607 |
| 3,195,721 | 7/1965 | Weckesser | 242/588.2 |
| 3,630,464 | 12/1971 | Fagan | 242/405.3 |
| 3,652,027 | 3/1972 | Wong | 242/396.2 |
| 4,179,081 | 12/1979 | Parry | 242/588 |
| 4,248,392 | 2/1981 | Parry | 242/588 |
| 4,285,477 | 8/1981 | Oxendahl et al. . | |
| 4,501,563 | 2/1985 | Johnson et al. | 242/405.3 |
| 4,575,020 | 3/1986 | Strout et al. | 242/588 |
| 4,600,163 | 7/1986 | Hummel et al. | 242/588 |
| 4,601,440 | 7/1986 | Wang | 242/396.4 |
| 4,872,623 | 10/1989 | Parry et al. | 242/588 |
| 5,094,395 | 3/1992 | Lambert | 242/588.2 |
| 5,186,411 | 2/1993 | Fanning et al. | 242/405.3 |
| 5,203,517 | 4/1993 | Parry et al. | 242/588.2 |
| 5,280,869 | 1/1994 | Ricci | 242/588.2 |
| 5,453,152 | 9/1995 | Mazzola et al. | 242/588.2 |
| 5,664,739 | 9/1997 | Black et al. | 242/588.2 |

*Primary Examiner*—John P. Darling
*Attorney, Agent, or Firm*—Chrisman, Bynum & Johnson; James R. Young

[57] ABSTRACT

A conventional roll of construction line can be outfitted with a reel having two shoulders connected by a shank through a spool on which the construction line is wound. The shank extends longitudinally from one of the shoulders and is releasably fastened to the other shoulder. A handle is mounted rotatably on either a longitudinal extension of the shank or one of the shoulders. Wedges on the shoulders engage the ends of the reel, and spurs on the shank engage the inside surface of the reel. A brake mechanism on the handle and a removable crank or winding knob are also provided.

23 Claims, 6 Drawing Sheets

ROTATABLE HANDLE FOR DISPOSABLE SPOOL

CROSS-REFERENCE TO RELATED PATENTS

This patent application is a continuation-in-part of U.S. patent application, Ser. No. 08/608,260, filed on Feb. 28, 1996, now U.S. Pat. No. 5,664,739, which is incorporated herein by reference.

BACKGROUND OF THE INVENTION

1. Field of the Invention

The invention relates to construction line reels, and more particularly, to a stronger and more convenient construction line reel on which a disposable spool holding wound construction line can be mounted and used repeatedly and, when the line is expended or no longer useful, can be re-used with a replacement spool of new line.

2. Description of the Prior Art

Construction workers, including carpenters, masonry workers, steel workers, and the like are frequently required to use long lengths of heavy string, hereinafter referred to as construction line, pulled tight between various points in order to establish straight lines. Straight lines are often necessary to aide in taking measurements or to properly align structural elements during construction. Since the use of a line reel for construction may subject the line reel to numerous environmental and operational hazards and conditions, the line reel must be rugged and capable of withstanding harsh use and treatment. Therefore, an inexpensive, rugged, and easy to use line reel for dispensing construction line is needed. Furthermore, many construction tasks are performed at high heights in partially completed structures where construction equipment, construction materials, and other workers may pose obstacles or hazards to the worker attempting to dispense the construction line, causing dangerous working conditions where the worker must be particularly careful and constantly alert. Therefore, it is desirable that the line reel be capable of being easily held and used with one hand, instead of requiring two hands, so that the construction worker will be able to focus his attention on maintaining his or her safety. These and other problems and concerns relating to use of construction line are described in more detail in the U.S. Pat. No. 4,285,477, issued to Oxendahl et al., which is incorporated herein by reference.

The construction line reel that is the subject of the U.S. Pat. No. 4,285,477, issued to Oxendahl et al. solved many of the problems described above. However, after the line is cut a number of times, tangled in knots, or just worn out, it has to be replaced. Since construction line is often purchased prewound around a cardboard or plastic spool, it would have to be unwound from the spool and wound onto the reel, which is a time consuming and sometimes frustrating task. Therefore, construction workers often prefer to just throw away the old line with the spool and all and just start with a new reel that already has new line on it. That approach works, but it is somewhat wasteful. Further, it does not solve a similar problem in manufacturing, wherein the line has to be unwound from spools and wound onto the reels. While this task can be automated and is easier than a construction worker doing it by hand, it is still a manufacturing step that costs.

Our rotatable handle for a disposable spool that is described in U.S. Pat. No. 5,664,739, which is also incorporated herein by reference, provided a solution to the problems described above by enabling a conventional spool of construction line to be fitted easily and quickly with a rotatable handle. In other words, rather than outfitting a reel with construction line, as was the conventional prior art approach, a spool of construction line could instead be outfitted with a rotatable reel and handle. That approach is still valid and a preferred manner of handling construction line. However, the rotatable reel apparatus described in U.S. Pat. No. 5,664,739 still had some deficiencies. For example, the lack of a shaft extending all the way through the cord spool leaves the end cap subject to being rotated in relation to the midsection or even pulled out of the cord spool by the construction line when the construction is being unwound or pulled in tension in a direction that is more parallel than perpendicular to the spool axis. While the alternate embodiment of FIGS. 8–13 of U.S. Pat. No. 5,664,739 helped, the center connection of the cap shank to the midsection shank inside the spool still leaves the structure a little too flimsy as well as inaccessible for detachment without destroying the old spool. The latter deficiency is particularly significant if there is still a substantial amount of old construction line left on the old spool to make it difficult to even tear or cut through the old spool to access the shank latch or in situations where the user prefers to save the old spool of line for some other use.

SUMMARY OF THE INVENTION

Accordingly, it is a general object of this invention to provide apparatus useable for outfitting a spool of construction line with a rotatable handle and line retaining shoulders.

A more specific object of this invention is to provide a more robust rotatable handle structure for disposable construction line spools that is capable of maintaining its structural integrity, spool retaining capability, and line retaining shoulder alignment under line loads that are either parallel or perpendicular to the spool axis.

Another specific object of the invention is to provide such robust handle outfitting apparatus for construction line spools that is easily removable from the construction line spools without having to damage or destroy the spools.

A further specific object of this invention is to provide such robust handle outfitting apparatus for construction line spools with enhanced line rewinding features.

Still another specific object of this invention is to provide a rotatable handle for outfitting construction line spools with a convenient brake mechanism for slowing or stopping rotation easily with little change in the user's grip on the handle.

It is another general object of this invention to provide a line reel for retaining, dispensing, and retrieving construction line or string from a spool that can be mounted directly onto the reel to eliminate the need to unwind the line from the spool and wind it onto the reel.

It is another general object of this invention to provide a line reel for retaining, dispensing, and retrieving construction line or string from spools having different lengths and diameters.

Another general object of this invention is to provide a line reel on which spools prewound with construction line or string can be removably mounted and replaced with other spools of prewound construction line or string.

Another general object of this invention is to provide a line reel that is rugged and inexpensive to manufacture.

Another general object of this invention is to provide a line reel that can be used to dispense construction line or string easily and safely with one hand from a prewound spool of such construction line or string.

A specific object of this invention is to provide a line reel that can be selectively connected to and removed from a prewound spool of construction line or string.

Another specific object of this invention is to provide a line reel that includes a handle that can be fastened securely to a spool of line or string in a manner that allows the spool to rotate freely in relation to the handle for dispensing line or string from the spool and for retrieving line or string onto the spool.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described therein, the apparatus of the present invention includes rotatable reel and handle apparatus for outfitting a conventional roll of construction line with a reel and handle to facilitate unwinding and winding the construction line from and back onto the roll, wherein the conventional roll of construction line is typified by being wound onto an elongated, hollow, cylindrical spool that has a longitudinal axis, a first end, a second end, and a hole extending axially along the longitudinal axis from the first end to the second end. The rotatable handle and reel apparatus is characterized by a first shoulder and a second shoulder adapted to be positioned on opposite sides of the roll of construction line adjacent the respective first end and second end of the spool and connected together in non-rotational relationship to each other and to the spool by an elongated shank that, when assembled with the roll of construction line and spool, extends axially through the hole in the spool and frictionally engages the spool. An elongated handle extends axially outward from either the first shoulder or the second shoulder in a direction opposite from the spool and is mounted to rotate in relation to the shank, the first shoulder, and the second shoulder about an axis that is axially aligned with the longitudinal axis of the spool. The roll of construction line on the spool, when outfitted with the rotatable reel and handle apparatus, can be held in one hand by a user grasping the handle, and the construction line can be unwound from the reel or wound back onto the same roll between the first shoulder and the second shoulder without releasing the user's grasp on the handle by spinning the roll, spool, and shoulders in relation to the handle. In a preferred embodiment, the shank extends from the first shoulder through the hole in the spool, slidably through the second shoulder in a keyed manner to prevent rotational movement between the second shoulder and the shank and axially outwardly beyond the second shoulder to also function as a spindle for rotational mounting of the handle. A brake mechanism is provided to control or prevent rotational movement between the handle and the shank, and the handle as well as the second shoulder are removable from the shank, so that the shank can be withdrawn from the spool. Barbs on the shank and wedges on the inside surfaces of the shoulders engage the spool to inhibit rotational movement between the spool and the shank and shoulders. Similar barbs on the shank outside the second shoulder retain the second shoulder in position on the shank. An optional crank knob assembly is provided for mounting on the first shoulder eccentric to the longitudinal axis of the shank to facilitate winding of the construction line onto the spool. Alternate embodiments have the main handle mounted rotatably on either the first shoulder or the second shoulder with the shank releasably connected to shoulder on which the handle is mounted or to the shoulder on the opposite side of the reel from the shoulder on which the handle is mounted.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the Drawings

DETAILED DESCRIPTION OF THE PREFERRED EMBODIMENTS

Figure 1:
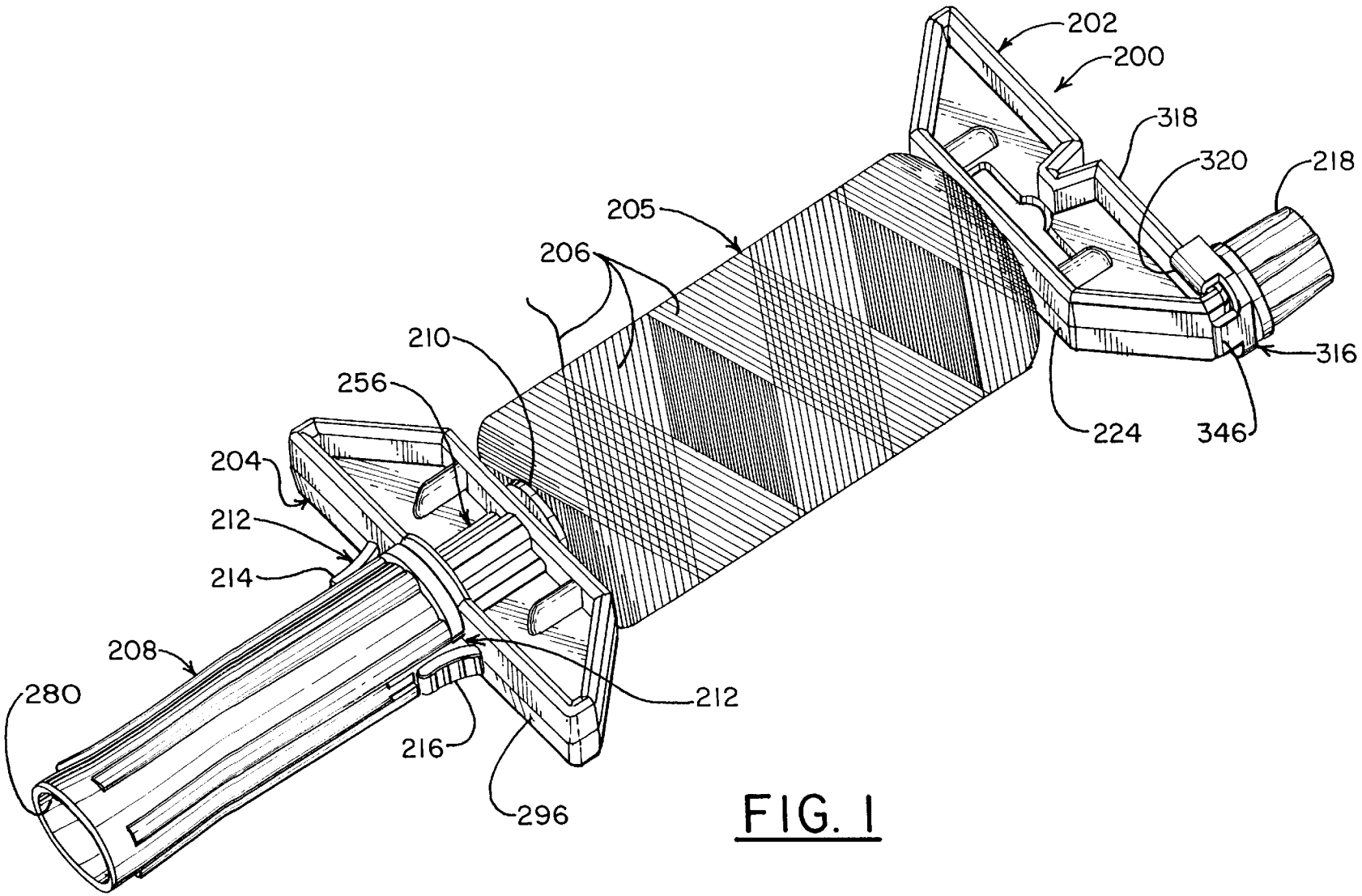
FIG. 1 is an isometric view of the preferred embodiment rotatable handle for disposable spool of this invention.

The rotatable wheel and handle assembly 200 of this invention includes many of the structural features, functions, and benefits that are described and shown in U.S. Pat. No. 5,664,739, which is incorporated herein by reference, so repetition of all of those structural features, functions, and benefits here is unnecessary. Suffice it to say that the rotatable wheel and handle assembly 200 of this invention provides a pair of shoulders 202, 204, as shown in FIG. 1, for retaining a roll 205 of construction line 206 and for guiding the construction line 206 off and back onto the roll 205 during unwinding and winding, respectively. Rolls of construction line 206 are usually wound onto cylindrical spools 210 for storage, shipment, and distribution. A main handle 208 is assembled in supporting, but rotational, relation to the shoulders 202, 204, so that a user (not shown) can grip the handle 208 of this invention to hold or support the roll 205 of construction line 206 as the roll 205 of construction line 206 spins in relation to the handle 208 while the line 206 is being unwound from, or wound onto, the spool 210 during use. A brake mechanism 212 actuated by squeezing a pair of thumb and finger buttons 214, 216 slows or prevents rotation of the shoulders 202, 204 and roll 205 of construction line 206 in relation to the handle 208. An optional winding knob 218 can be mounted on one of the shoulders, preferably the end shoulder 202 on the opposite end of the roll 205 from the handle 208. The winding knob 218 can be grasped by the thumb and fingers of one hand to rotate the spool 210 and wind construction line 206 onto the roll 205 while the handle 208 is held by the user's other hand to support the spool 210 and roll 205.

Figure 2:
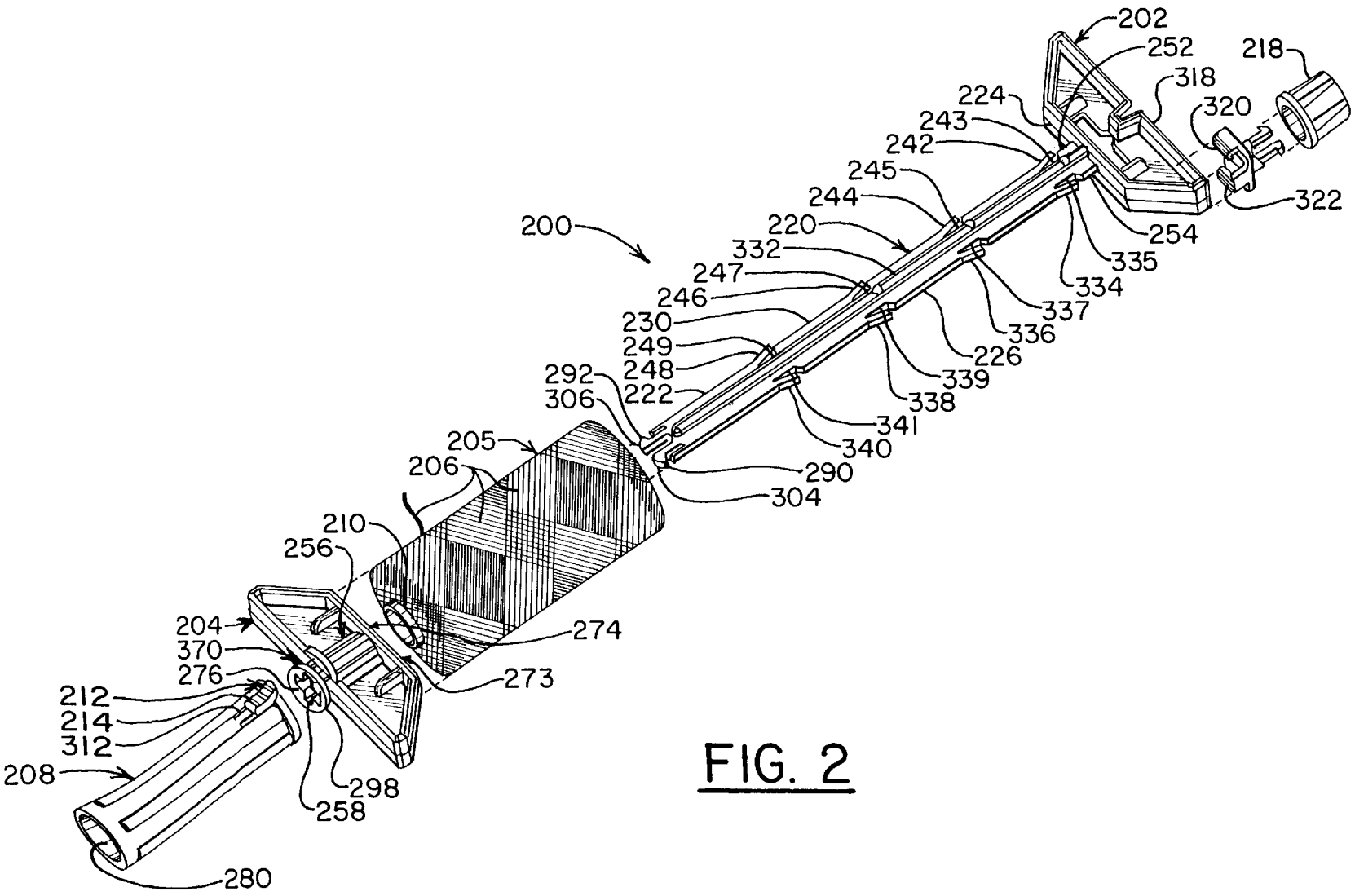
FIG. 2 is an isometric exploded view of the preferred embodiment rotatable handle of FIG. 1 to reveal the principle components of the apparatus.
Figure 3:
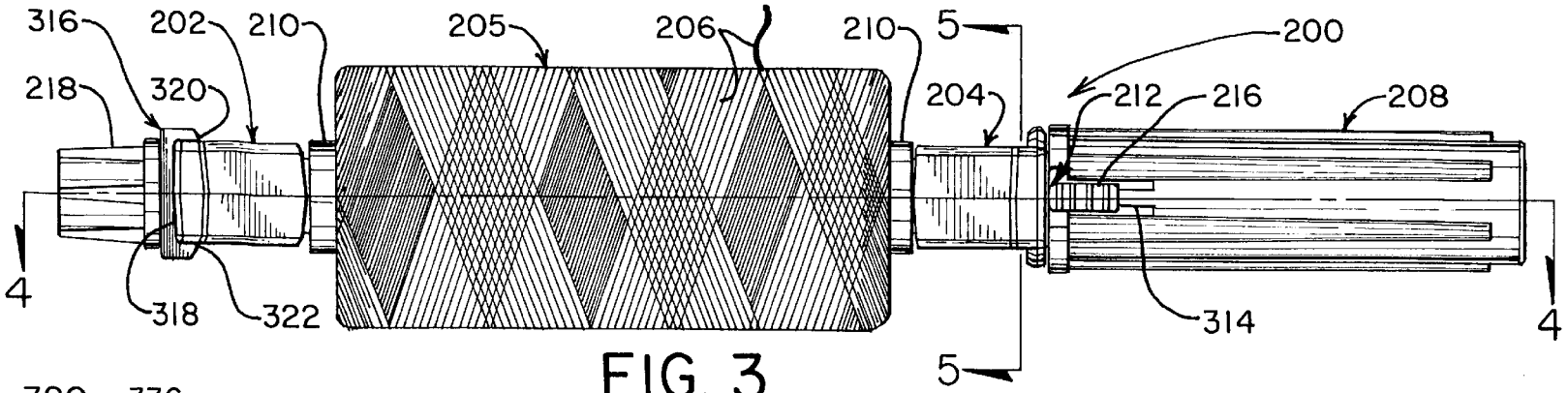
FIG. 3 is a side elevation view of the preferred embodiment rotatable handle of FIG. 1.
Figure 4:
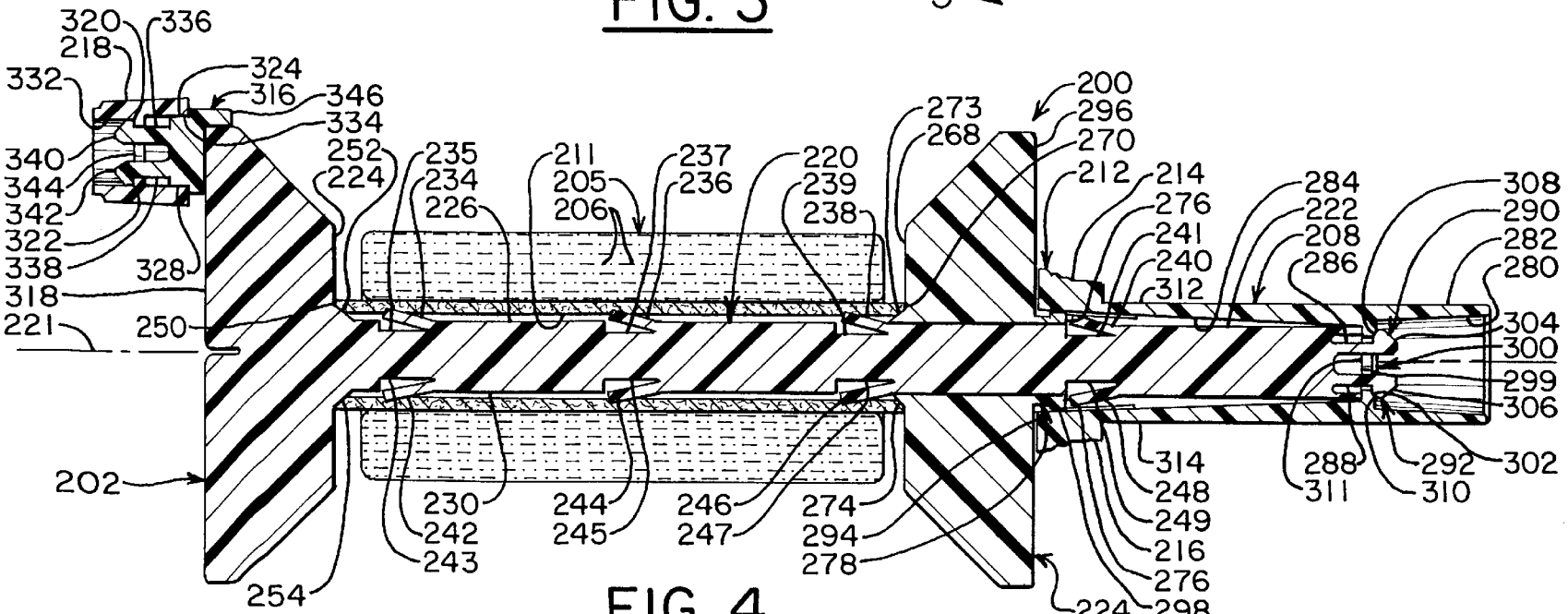
FIG. 4 is a cross-sectional view of the preferred embodiment rotatable handle taken substantially along line 4—4 of FIG. 3.

Referring now to FIGS. 2–4, one of the significant features of this invention is an elongated shank 220 that extends from one shoulder 202 all the way through the spool 210, where the other shoulder 204 connects to the shank 220 in a manner that prevents rotation of the shoulders 202, 204 in relation to each other while also mounting the spool 210 in a manner that prevents rotation of the spool 210 and roll 205 of construction line 206 in relation to the shoulders 202, 204, as will be described in more detail below. Another feature of this invention is the extension of the shank 220 through the shoulder 204 in a keyed manner that prevents rotation of shoulder 204 in relation to shank 220 and continues to extend beyond the shoulder 204 to serve as a spindle 222 for rotatably mounting the handle 208 in a manner that prevents axial movement of shoulder 204 and provides the brake structure 212, as will also be described in more detail below.

More specifically, as shown in FIGS. 2–4, the shank 220 is a solid extension of the inside rim 224 of the end shoulder 202, so there is no relative movement between shank 220 and shoulder 202. The shank 220 has a plurality of splines 226, 228, 230, 232 that extend radially outward from the longitudinal axis of the shank 220 along most of the length of the shank 220. In the preferred embodiment 200 illustrated in FIGS. 2–4, there are four of such splines 226, 228, 230, 232 that extend substantially the entire length of the shank 220 for the added strength they impart to the shank 220 as well as continuous key and guide surfaces for convenient assembly. However, more or fewer splines would also work, and they could be positioned intermittently, rather than continuously, along the length of the shank 220 at appropriate places, the locations of which will become more apparent as this description proceeds.

Each spline 226, 228, 230, 232 has a plurality of resilient barbs 234, 236, 238, 240 and 242, 244, 246, 248 that protrude outwardly from respective splines 226, 230, but which are yieldably resistant to forces that depress them toward the longitudinal axis 221 of the shank 220. The splines 226, 230 have correspondingly located cavities 235, 237, 239, 241 and 243, 245, 247, 249 large enough to receive the depressed respective barbs 234, 236, 238, 240 and 242, 244, 246, 248. Therefore, the barbs 234, 236, 238 and 242, 244, 246 on respective splines 226, 230 are depressed by the inside surface 211 of spool 210 as the shank 220 is inserted through the spool 210, yet their resilience causes them to resist such depression and to frictionally engage the inside surface 211 of the spool 210 to resist both rotational and axial movement of the spool 210 in relation to the shank 220.

The shank 220 is preferably inserted all the way through the spool 210 until the inside surface 224 of shoulder 202 abuts the leading end 250 of spool 210. A pair of tetrahedron shaped wedges 252, 254 protrude axially inward from the surface 224 and radially outward from the splines 226, 230 to engage the end 250 of spool 210 to further inhibit rotational movement of the spool 210 and roll 205 of construction line 206 in relation to the shank 220 and shoulder 202.

Figure 5:
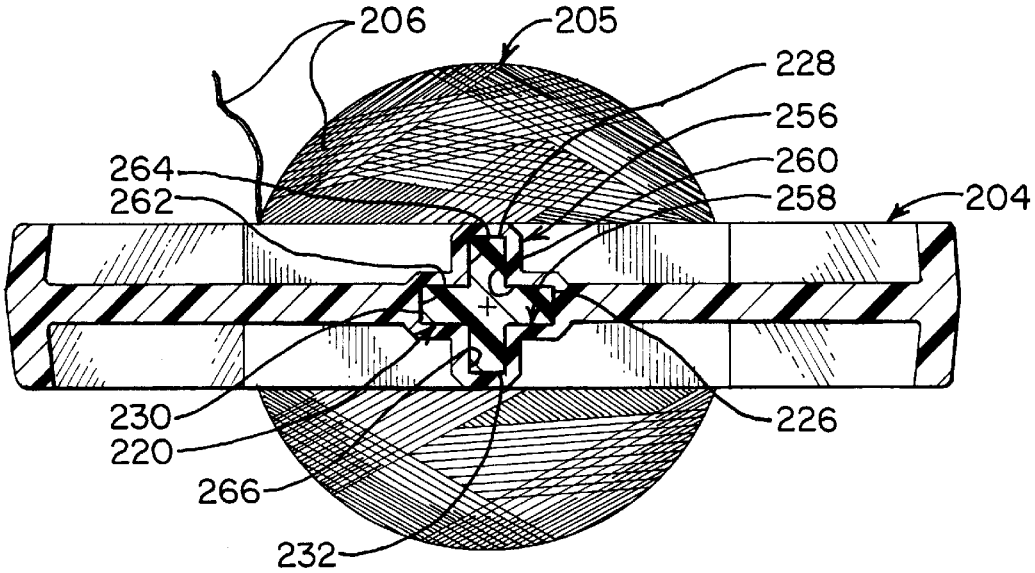
FIG. 5 is a cross-sectional view of the preferred embodiment rotatable handle of FIG. 1 taken along line 5—5 of FIG. 3 through the proximal spool retainer and the splined shaft.
Figure 6:
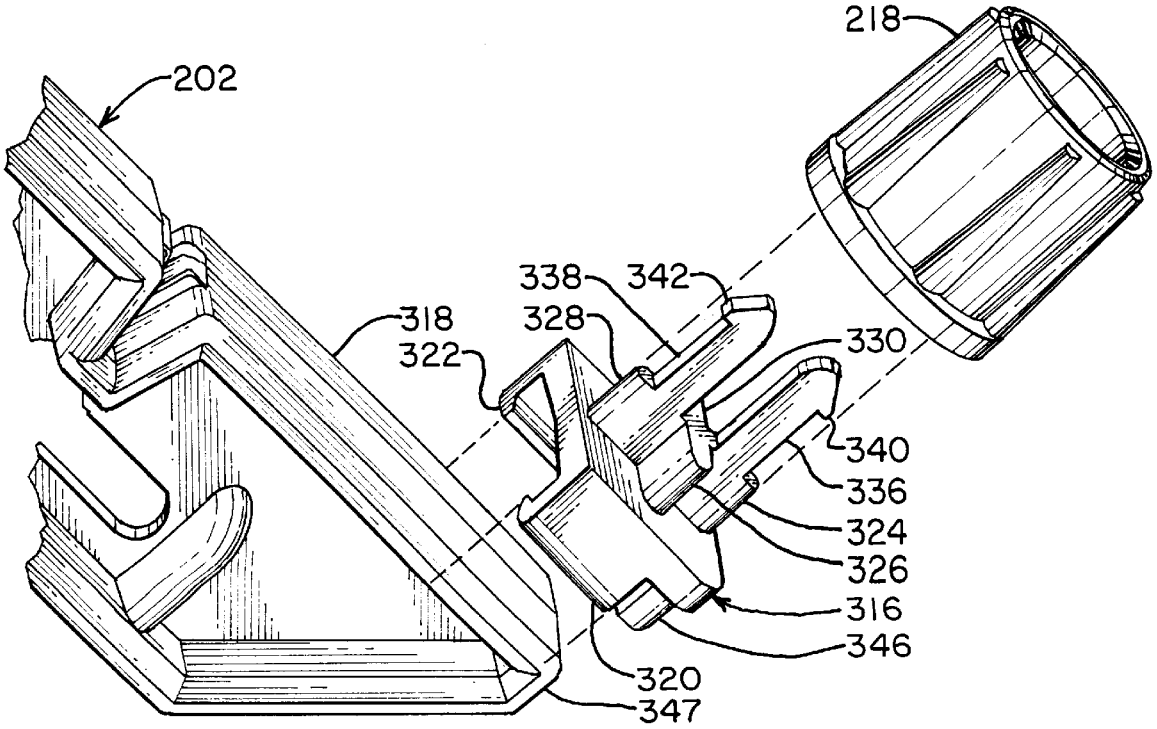
FIG. 6 is an enlarged exploded view of the crank knob assembly.

The other shoulder 204, as best seen in FIGS. 2, 4, and 5, has a core housing 256 with a keyed hole 258 extending axially through the core housing 256. The keyed hole 258 is shaped and sized with a plurality of key ways 260, 262, 264, 266 to matingly receive the splines 226, 228, 230, 232 of the shank 220. The shoulder 204 slides axially onto the shank 220 until the inside surface 268 of shoulder 204 abuts the end 270 of spool 210 that is opposite end 250. A pair of sharp, tetrahedron shaped wedges 273, 274 protrude from the inside surface 268 of shoulder 204 into engagement with the end 270 of spool 210 to resist rotational movement of the spool 210 in relation to the shoulder 204. At the same time, the key ways 260, 262, 264, 266 in the core housing 256 of shoulder 204 interact with mating splines 226, 228, 230, 232 of shank 220 to prevent rotational movement of the spool 210 and roll 205 of construction line 206 in relation to the shank 220.

Referring again primarily to FIG. 4, two of the barbs 240, 248 on respective splines 226, 230 must be depressed into respective cavities 241, 249 to accommodate sliding the shoulder 204 over the shank 220 into abutment with the spool 210. When the shoulder 204 is in that abutting position, the barbs 246, 248 return resiliently outward, as shown in FIG. 4 to abut the axial surface 276 of an annular collar 278 that protrudes axially outward from the core housing 256 of shoulder 204, which prevents axially outward movement of shoulder 204 on shank 220, thereby retaining the shoulder 204 in abutment with the end 270 of spool 210.

As mentioned above, in the preferred embodiment 200 of FIGS. 1–5, the terminal portion 222 that extends outward from the shoulder 204 is a spindle on which the main handle 208 is mounted. As best seen in FIG. 4, the main handle 208 is in the shape of an elongated cylinder with an axial hole 280 therethrough, an external surface 282, and an internal surface 284. The spindle 222 terminates with a pair of axially extending dogs 286, 288, each of which has a radially outward extending lobe 290, 292 at its distal end. The internal surface 284 of the handle 208 extends over the spindle 222 with one end 294 of the handle 208 positioned adjacent the outside surface 296 of the shoulder 204 and concentrically around the peripheral surface 298 of the collar 278. From the end 294, the internal surface 284 tapers toward the terminal end 299 of spindle 222, where an annular flange 300 extends radially inward. The dogs 286, 288 are yieldingly resistant to radial inward forces and sufficiently resilient to return radially outward upon removal of such radial inward forces. Each lobe 290, 292 also has a slanted cam surface 304, 306 on its outside edge. As the annular flange 300 is forced over the cam surfaces 304, 306 toward shoulder 204 during assembly, radial force components resulting from the action of the flange 300 on the cam surfaces 304, 306 force the dogs 286, 288 with their respective lobes 290, 292 radially inward to allow the annular flange 300 to pass over the lobes 290, 292 into the position described above. The annular flange 300 also has a latch surface 302 positioned to interface with mating latch surfaces 308, 310 on the inside edges of the respective lobes 290, 292 in a manner that restrains the handle 208 against withdrawal from the spindle 222, but which allows the handle 208 to rotate on the spindle 222. In the preferred embodiment 200, the interfacing latch surfaces 308, 310 and 302 are slanted radially outwardly from the longitudinal axis 221 and axially away from the shoulder 204 so that a sufficient force applied on the handle 208 directed axially away from the shoulder 204 will cam the lobes 290, 292 on respective dogs 286, 288 radially inward enough to allow the handle 208 to be removed from the spindle 222 so that the shoulder 204 and shank 220 can be removed from the spool 210, as will be described in more detail below. As an alternative, if it is desired to prevent disassembly and removal of the rotatable reel and handle apparatus 200 from the spool 210, the mating latch surfaces 308, 310 and 302 can be made perpendicular (not shown) to the longitudinal axis 221 or even slanting radially outward and toward (not shown) the shoulder 204 so that they do not cam the lobes 290, 292 and dogs 286, 288 radially inward to unlatch the handle 208 from the spindle 222. The end 299 of spindle 222 bears against the inside annular surface 311 of flange 300 to limit axial movement of the handle 208 toward shoulder 204.

Another feature of this invention is the brake mechanism 212, which is best seen in FIGS. 1–4. The brake buttons 214, 216 are formed on the distal ends of respective fingers 312, 314, which are extensions of, but partially separated from, the cylindrical handle 208 so that they extend over the peripheral surface 298 of collar 278. The fingers 312, 314 are bendable resiliently into contact with the peripheral surface 298 of collar 278 under radially inward forces applied by a user (not shown). With enough radially inward force applied to the brake buttons 214, 216, the resulting frictional engagement of the fingers 312, 314 with the peripheral surface 298 can prevent the shoulders 202, 204 and shank 220 from rotating in relation to the handle 208. Therefore, when the user (not shown) has a tight grip on the handle 208 and applies enough force on the brake buttons 214, 216, the spool 210 can be prevented from spinning on shank 220, thus preventing construction line 206 from unwinding from the roll 205. Of course, lesser magnitudes of radial force applied to the brake buttons 214, 216 can allow the construction line 206 to be unwound, but under resistance.

The brake buttons 214, 216 can also facilitate in disassembly of the rotatable reel and handle apparatus 200. As described above, in the preferred embodiment, the handle 208 can be forced axially away from the shoulder 204 by applying enough force to cam the lobes 290, 292 radially inward to clear the flange 300. When the handle 208 is moved axially far enough in this manner for the distal ends of the fingers 312, 314 to clear the collar 278, the brake buttons 214, 216 can be used to depress the barbs 240, 248 into their respective cavities 241, 249 so that the shoulder 204 can be pulled axially off the shank 220 along with the handle 208. With the shoulder 204 removed from the shank 220, the shank 220 can also be removed from the spool 210. The barbs 240, 248 can, of course, also be depressed in other ways, but the brake buttons 214, 216 provide a convenient instrumentality for doing so.

The winding knob 218, as best seen in FIGS. 1–4 and 6, is optional, but it is preferably mounted on the end shoulder 202 in a removable manner. A convenient removable knob mounting bracket 316 snaps onto the outside rim 318 of the end shoulder 202. The bracket 316 has a pair of lips 320, 322 that snap resiliently around opposite edges of the rim 318 to retain the bracket 316 on the rim 318. The knob 218 is generally cylindrical in shape with a round hole 332 extending axially through its center for mounting rotatably on the bracket 316. Alignment guides 324, 326, 328, 330 on bracket 316 protrude into the hole 332 in knob 218 and interface with the inside surface 334 to support the knob 218 in a rotatable manner. Dogs 336, 338 extend axially from guides 324, 328 and terminate in respective radially outwardly protruding lobes 340, 342, which interact with an annular flange 344 around the inside surface 334 of the knob 218 to retain the knob 218 in place rotatably on the bracket 316. The bracket 316 with the knob 218 can be removed from the shoulder 202 by forcing the lips 320, 322 off the rim 318. It can be remounted again by forcing the lips 320, 322 over the rim 318. The end wall 346 on bracket 316 helps to retain the bracket 316 in a position at an edge 347 of the shoulder 202, where the knob is eccentric to the longitudinal axis 221. In that position, as the main handle 308 is grasped in one hand, the knob 218 can be used as a crank to turn the spool 210 to wind or unwind the construction line 206.

Figure 7:
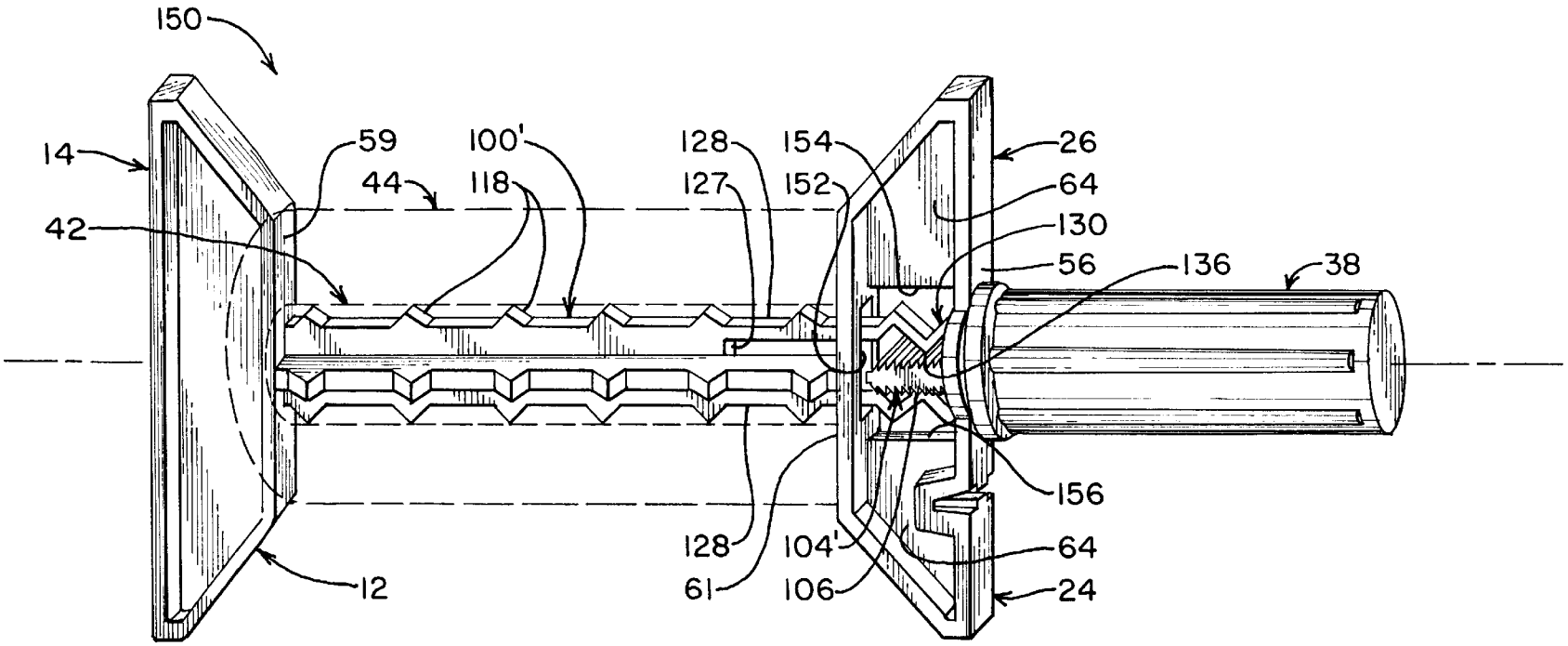
FIG. 7 is an isometric view of an alternate embodiment rotatable handle apparatus in which the shank extends from the cap section through the spool and connects to the midportion in the proximal spool retainer.

Another embodiment 150 of the rotatable reel and handle apparatus of this invention, as shown in FIG. 7, also has an elongated shank 100' extending from the abutment surface 59 of the retainer shoulder 14 of cap 12 a distance sufficient to extend through the construction line spool 42 to attach to the midsection 24 in the midsection shoulder 26. The spool 42 and construction line 44 are shown in phantom lines to show their assembled relationship to the rotatable handle apparatus 160 without masking structural details of the apparatus 160. The attachment of the shank 100' to the midsection 24 can be accomplished with a pair of prongs 128 extending longitudinally from an end 127 of shank 100' into engagement with teeth 106 on a core wedge 104' that protrudes longitudinally from a back rim 56 of the midsection shoulder 26. The prongs 128 extend through an opening 152 in the front rim 61 into an opening between edges 154, 156 of web 64. Prong edges 136 engage the teeth 106 on the core wedge 104' to inhibit separation of the shank 100' from the midportion 24. Prong tips 130 facilitate spreading the prongs 128 to disengage the prong edges 136 from the core wedge 104'. The handle 38 can be mounted rotatably on the midsection 24 as taught in U.S. Pat. No. 5,664,739, which is incorporated herein by reference, so further details of such mounting are not needed here.

To mount this rotatable reel and handle apparatus 150 on a spool 42 containing a wound bundle of construction cord 44, the shank 100' is first pushed through the spool 42. The shank 100' preferably sized such that the teeth 118 engage the inside surface of the spool 42, as described in U.S. Pat. No. 5,664,739, which is incorporated herein by reference. The prongs 128 are then inserted through a hole 152 in the front surface 61 of shoulder 26 and into engagement with the teeth 106 on core wedge 104'. The prongs 128 are resiliently flexible enough to yield enough to push the tip edges 136 over the teeth 106 during assembly, but to engage the teeth 106 to prevent separation of the shank 100' from the midportion 24 during use. However, if the user does desire to remove the rotatable reel and handle apparatus from the spool 42, the prong tips 130 can be spread apart to disengage the tip edges 136 from the teeth 106 of core wedge 104'. The hole 152 is preferably rectangular with a transverse dimension only enough larger than a transverse dimension of the prongs 128 so that the prongs 128 interacting with the peripheral surfaces of hole 152 prevent rotation of the shank 100' in relation to the shoulder 26. Of course, since the shank 100' is a solid extension of the surface 59 of cap shoulder 14, the shank 100' is also not rotatable in relation to cap shoulder 14. Therefore, the interaction of the prongs 128 with the peripheral surfaces of the hole 152 prevent the shoulders 14, 26 from rotating in relation to each other during use.

Figure 8:
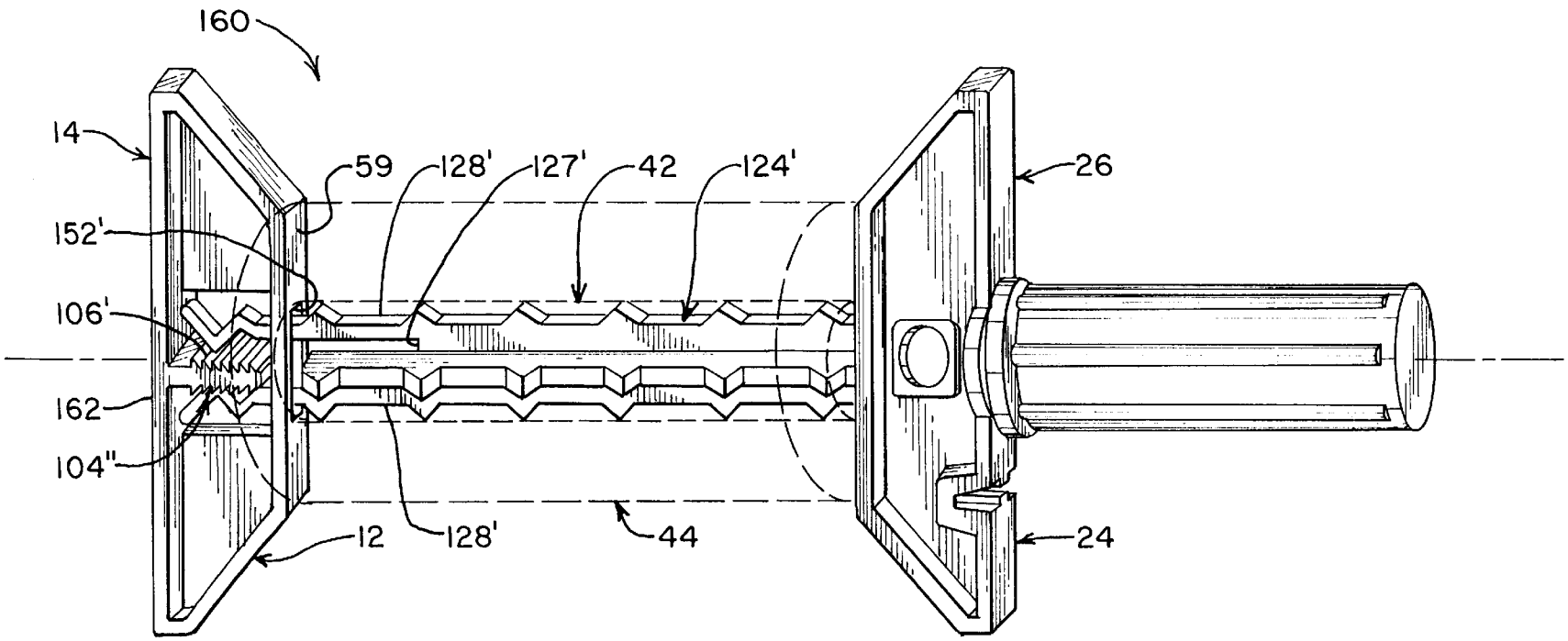
FIG. 8 is an isometric view of another alternate embodiment rotatable handle apparatus in which the shank extends from the proximal retainer or midportion through the spool and connects to the end cap.

The rotatable reel and handle embodiment 160 shown in FIG. 8 is similar to the embodiment 150 of FIG. 7, except that the elongated shank 124' extends from the midsection 24 through the spool 42 to connect to the cap section 12. The attachment of the shank 124' to the cap section 12 can be accomplished 150 in FIG. 7 with prongs 128' that extend from an end 127' of shank 124' through a hole 152' in face 59 of the cap shoulder 104", which protrudes from the rim 162 of shoulder 12 toward the hole 152'. As in the embodiment 150, the peripheral surface of the rectangular hole 152' interacts with the prongs 128' to prevent the cap shoulder 14 from rotating in relation to the shank 124' and in relation to the midsection shoulder 26.

The foregoing description is considered as illustrative only of the principles of the invention. Furthermore, since a number modifications and changes will readily occur to those skilled in the art, it is not desired to limit the invention to the exact construction and process shown described above. Accordingly, all suitable modifications and equivalents may be resorted to falling within the scope of the invention as defined by the claims which follow.

We claim:

1. Rotatable reel and handle apparatus for outfitting a roll of construction line with a reel and handle to facilitate unwinding and winding the construction line from and back onto the roll, wherein the roll of construction line is wound onto an elongated, hollow, cylindrical spool that has a longitudinal axis, a first end, a second end, and a hole extending axially along the longitudinal axis from the first end to the second end, said rotatable handle and reel apparatus being characterized by a first shoulder and a second shoulder adapted to be positioned on opposite sides of the roll of construction line adjacent the respective first end and second end of the spool and connected together in non-rotational relationship to each other and to the spool by an elongated shank that, when assembled with the roll of construction line and spool, extends axially through the hole in the spool and frictionally engages the spool, and an elongated handle extending axially outward from either the first shoulder or the second shoulder in a direction opposite from the spool and which is mounted to rotate in relation to the shank, the first shoulder, and the second shoulder about an axis that is axially aligned with the longitudinal axis of the spool, whereby the roll of construction line on the spool, when outfitted with the rotatable reel and handle apparatus, can be held in one hand by a user grasping the handle and the construction line can be unwound from the roll or wound back onto the same roll between the first shoulder and the second shoulder without releasing the user's grasp on the handle by spinning the roll, spool, and shoulders in relation to the handle.

2. The rotatable reel and handle apparatus of claim 1, wherein the shank extends from said first shoulder through said hole in the spool to said second shoulder, and wherein said second shoulder is releasably connected to said shank.

3. The rotatable reel and handle apparatus of claim 2, wherein said handle is mounted in a rotatable manner on said second shoulder.

4. The rotatable reel and handle apparatus of claim 3, wherein said shank and said second shoulder have mating latch mechanisms that connect the shank in non-rotational relation to the second shoulder.

5. The rotatable reel and handle apparatus of claim 4, wherein said mating latch mechanisms are releasable from each other.

6. The rotatable reel and handle apparatus of claim 4, wherein the second shoulder has a hole with a non-round cross-section in axial alignment with the shank, the shank has a non-round cross-section that extends into the hole in the second shoulder and is sized to interact with sides of the hole to inhibit rotational movement between the shank and the second shoulder.

7. The rotatable reel and handle apparatus of claim 3, wherein said shank and said first shoulder have mating latch mechanisms that connect the shank in non-rotational relation to the first shoulder.

8. The rotatable reel and handle apparatus of claim 7, wherein said mating latch mechanisms are releasable from each other.

9. The rotatable reel and handle apparatus of claim 7, wherein the first shoulder has a hole with a non-round cross-section in axial alignment with the shank, the shank has a non-round cross-section that extends into the hole in the first shoulder and is sized to interact with sides of the hole to inhibit rotational movement between the shank and the first shoulder.

10. The rotatable reel and handle apparatus of claim 1, wherein the shank extends from said first shoulder through said hole in the spool and through said second shoulder in a keyed manner and for a distance beyond said second shoulder to form a spindle, said handle being mounted on said spindle in rotational relation to said shank.

11. The rotatable reel and handle apparatus of claim 10, including a retainer on the shank that interacts with the second shoulder to releaseably restrain the second shoulder against axial movement in a direction away from the spool.

12. The reel and handle apparatus of claim 1, including a winding knob mounted on the first shoulder eccentric to the longitudinal axis of the spool.

13. The rotatable reel and handle apparatus of claim 10, including a winding knob mounted on the first shoulder eccentric to the longitudinal axis of the spool.

14. The rotatable reel and handle apparatus of claim 10, including resiliently bendable barbs on the shank that extend radially outward from the shank to engage the inside surface of the spool.

15. The reel and handle apparatus of claim 10, including a wedge extending axially from the first shoulder onto engagement with the first end of the spool.

16. The reel and handle apparatus of claim 10, including a wedge extending axially from the second shoulder into engagement with the second end of the spool.

17. The reel and handle apparatus of claim 10, wherein the shank has a plurality of radially outward extending splines, said second shoulder has a keyed hole extending through the second shoulder with a plurality of radially extending keyways that are matched in size and shape to said splines.

18. The reel and handle apparatus of claim 17, including a resilient retainer in the form of a barb extending radially outward from a spline with a mating cavity recessed into the spline, said shank being slideable axially through the keyed hole when the barb is depressed into the cavity, said barb extending radially outward at an angle less than perpendicular to the longitudinal axis so that it is cammed into the cavity by the second shoulder sliding axially on the shank in one direction, but inhibits the second shoulder from sliding in the opposite axial direction on the shank.

19. The rotatable reel and handle apparatus of claim 10 including a brake mechanism on the handle that is actuateable by the user to inhibit rotary motion of the shank in relation to the handle.

20. The reel and handle apparatus of claim 19, wherein the second shoulder has a collar with a peripheral surface protruding axially outward toward the handle, and wherein the brake mechanism includes a resilient finger extending from the handle to a position radially outward from the peripheral surface of the collar and a button on the resilient finger to facilitate pressing the finger into frictional engagement with the peripheral surface of the collar.

21. In a rotatable reel and handle apparatus for holding a roll of construction line on the reel between two shoulders that are spaced a distance apart from each other along a longitudinal axis, wherein one of the shoulders has a distal rim extending generally transversely through the longitudinal axis and a rotatable handle extends longitudinally outward from the other of the shoulders, the improvement comprising:

removable crank apparatus mounted removably on said one of the shoulders with a bracket that has a pair of resilient lips spaced apart from each other a sufficient distance to snap around opposite edges of the distal rim to retain the bracket in a removable manner on the rim, and a winding knob mounted rotatably on the bracket in an orientation such that the winding rod rotates about a crank axis that is parallel and eccentric to the longitudinal axis.

22. The improvement of claim 21, wherein said one of said shoulders has an outer edge and said bracket has an end wall that abuts said edge when said lips are snapped around opposite edges of the distal rim.

23. The improvement of claim 21, wherein said knob has a round hole extending longitudinally therethrough to form an inside cylindrical surface in said knob and an annular flange protruding radially inward from said inside surface, and wherein said bracket has a plurality of alignment guides protruding into said hole adjacent said inside surface as well as a plurality of resilient dogs extending into said hole and terminating in radially outwardly protruding lobes that engage said annular flange in a manner that allows rotation of the knob in relation to the bracket while retaining said knob on said bracket.

* * * * *